US006092702A

United States Patent [19]

Cassidy, IV

[11] Patent Number: 6,092,702

[45] Date of Patent: Jul. 25, 2000

[54] MULTI-PURPOSE BAG AND METHOD FOR ITS USE

[76] Inventor: Edward J. Cassidy, IV, 184 Bellevue Ave., Upper Montclair, N.J. 07043

[21] Appl. No.: 08/929,583

[22] Filed: Sep. 15, 1997

[51] Int. Cl.[7] ..... A45F 4/02; A45F 3/04

[52] U.S. Cl. ..... 224/153; 224/579; 224/581; 224/585; 224/630; 224/616; 224/645; 224/617; 224/652; 224/653; 224/655; 224/237; 224/675; 224/420; 224/439; 383/2; 383/76; 383/117

[58] Field of Search ..... 224/153, 578, 224/579, 580, 581, 582, 584, 585, 586, 627, 645, 616, 617, 683, 237, 652, 653, 655, 630, 675, 420, 439; 383/2, 4, 117, 112, 33, 13, 15, 76; 190/103; 150/118

[56] References Cited

U.S. PATENT DOCUMENTS

| | | | |
|---|---|---|---|
| 2,407,787 | 9/1946 | Kernahan | 224/627 |
| 3,938,716 | 2/1976 | Jackson et al. | 224/153 |
| 4,388,739 | 6/1983 | Martinon et al. | 383/117 |
| 4,515,300 | 5/1985 | Cohen | 224/579 |
| 5,150,824 | 9/1992 | Alvarez et al. | 224/586 |
| 5,692,660 | 12/1997 | Stewart | 224/581 |
| 5,704,528 | 1/1998 | Faure | 224/153 |
| 5,797,529 | 8/1998 | Lavine | 224/153 |

FOREIGN PATENT DOCUMENTS

| | | | |
|---|---|---|---|
| 167018 | 10/1954 | Australia | 383/2 |

*Primary Examiner*—Linda J. Sholl
*Attorney, Agent, or Firm*—Thomas L. Adams, Esq.

[57] ABSTRACT

A multi-purpose bag has a mesh pouch and a sleeve with a pair of ends. The pouch is attached along an annular seam to one of the ends of the sleeve. The other end of the sleeve has a closable mouth. Also included is a restricting feature for stowing the pouch to stop communication from inside the sleeve to inside the pouch. The multi-purpose bag can be used by stowing the pouch to stop communication from inside the sleeve to inside the pouch. The sleeve can at this time be at least partially filled before closing the sleeve.

24 Claims, 3 Drawing Sheets

MULTI-PURPOSE BAG AND METHOD FOR ITS USE

FIELD OF THE INVENTION

The present invention relates to a multipurpose bag, and in particular, to a bag that can be configured in different sizes and uses various straps to provide different methods of attachment. This provides the user with a unique bag that has many applications and provides different points for attaching straps to present the most flexible means of carrying or hanging the bag.

DESCRIPTION OF RELATED ART

A carrying bag for water sports has a cloth sleeve attached to a pouch made of netting. The netting allows, water, sand and other fine debris to fall or drain from the bag. This known carrying bag lacks the ability to change its carrying shape or capacity, in order to accommodate packages of varying sizes. This bag also lacks the flexibility to be carried by hand, on the shoulder, on the back, etc.

In U.S. Pat. No. 4,613,039 a garment bag has on its bottom an extension bag. The extension bag can be tucked inside the main bag and kept in place by subsequently zipping closed the bag at its joint with the extension. Alternately, the extension bag can be folded up against the outside of the main bag. The main bag itself can then be folded in half. This bag is dedicated to clothing and lacks the flexibility for carrying wet articles or the ability to shed sand or other fine debris.

U.S. Pat. No. 2,729,257 shows a bag whose lower section can be collapsed inwardly and kept shortened by an external zipper. Again, this bag lacks the capability for carrying wet articles or the ability to shed sand or other fine debris. Also lacking are various alternatives for carrying by hand, shoulder, back, etc.

U.S. Pat. No. 2,212,390 shows a bag having flexible upper walls that can be closed on the top by a drawstring. The flexible walls can also be turned inside the bag to shorten it. The reference shows changing the size of the bag by effectively eliminating the upper portion. This bag lacks the ability to shed water, sand, etc.

U.S. Pat. No. 2,493,085 shows a circular pouch that is open along 180°. A tubular mesh bag is stitched to the wall 14 of the pouch 11. Thus, the pouch can either act as the floor of the mesh bag or be turned inside out to allow the mesh bag to be folded and stored in the pouch. This arrangement also lacks flexibility to properly carry various articles. See also U.S. Pat. No. 2,164,641.

U.S. Pat. Nos. 4,153,092; 4,887,751; and 5,431,317 show various bags having strapping alternatives so that the bag can be carried as a handbag, a backpack, a shoulder bag and the like. However, these bags have none of the capabilities for reconfiguring the bag to carry various articles. See also U.S. Pat. Nos. 3,888,397 and 3,955,728.

U.S. Pat. No. 5,377,887 shows a bag that can be turned inside out to expose either shoulder straps or carrying handles (in addition a shoulder strap can be attached to the bag). The reference lacks a mechanism for changing the effective size of the bag.

See also U.S. Pat. Nos. 4,287,971, 4,878,606 and 5,337,933.

Accordingly, there is a need for an improved carrying bag that can be used to carry different sized items and which has multiple configurations. An object of is to provide a bag for carrying items of various sizes that can be rapidly adapted to varying loads. Also needed is a bag that would have multiple applications with the capability of changing its operating features. For example, the bag could be reconfigured to either allow or prevent the shedding of sand, fine debris, water, etc. Moreover, a preferred bag should have alternative methods of being carried or supported.

SUMMARY OF THE INVENTION

In accordance with the illustrative embodiments demonstrating features and advantages of the present invention, there is provided a multi-purpose bag having a pouch and a sleeve adjoined to the pouch. The sleeve has a closable mouth. Also included is a restrict means for stowing the pouch to stop communication from inside the sleeve to inside the pouch.

A method in accordance with a another aspect of the present invention can use a multi-purpose bag having a sleeve adjoining a pouch. The method includes the step of stowing the pouch to stop communication from inside the sleeve to inside the pouch. The method also includes the steps of at least partially filling the sleeve and closing the sleeve.

By employing apparatus and methods according to the foregoing a versatile carrying bag is achieved that can carry a wide variety of items and can be reconfigured to achieve different purposes. In a preferred embodiment, the bag has at least three different size configurations. In this embodiment, a mesh pouch is sewn to the lower hem of a cloth sleeve. In its largest form, the sleeve communicates with the mesh pouch to create a large carrying space.

A drawstring around the upper portion of the mesh pouch may be used to separate the mesh portion from the upper sleeve. The mesh pouch is tucked into the sleeve before drawing the drawstring. The drawstring effectively reduces the size of the bag. The sleeve then uses the mesh as a floor for a mid-sized bag.

Alternatively, the mesh pouch can be rolled and stowed at the bottom of the sleeve. In the smallest arrangement the sleeve, acting as a bag, can be folded over and closed with Velcro® hook and loop fastening material. In this configuration the bag can be attached to a belt or a bicycle handlebar.

The bag can be carried on straps that adapt to carrying by hand, shoulder or back. A single strap may be attached to rings on the back of the bag and can be carried as a shoulder bag. A pair of straps may be attached to the upper and lower rings and the bag can be used as a backpack.

BRIEF DESCRIPTION OF THE DRAWINGS

The above brief description as well as other objects, features and advantages of the present invention will be more fully appreciated by reference to the following detailed description of presently preferred, but nonetheless illustrative embodiments in accordance with the present invention, when taken in conjunction with the accompanying drawings, wherein.

DETAILED DESCRIPTION OF THE PREFERRED EMBODIMENTS

Figures 1, 2, 3, 4:
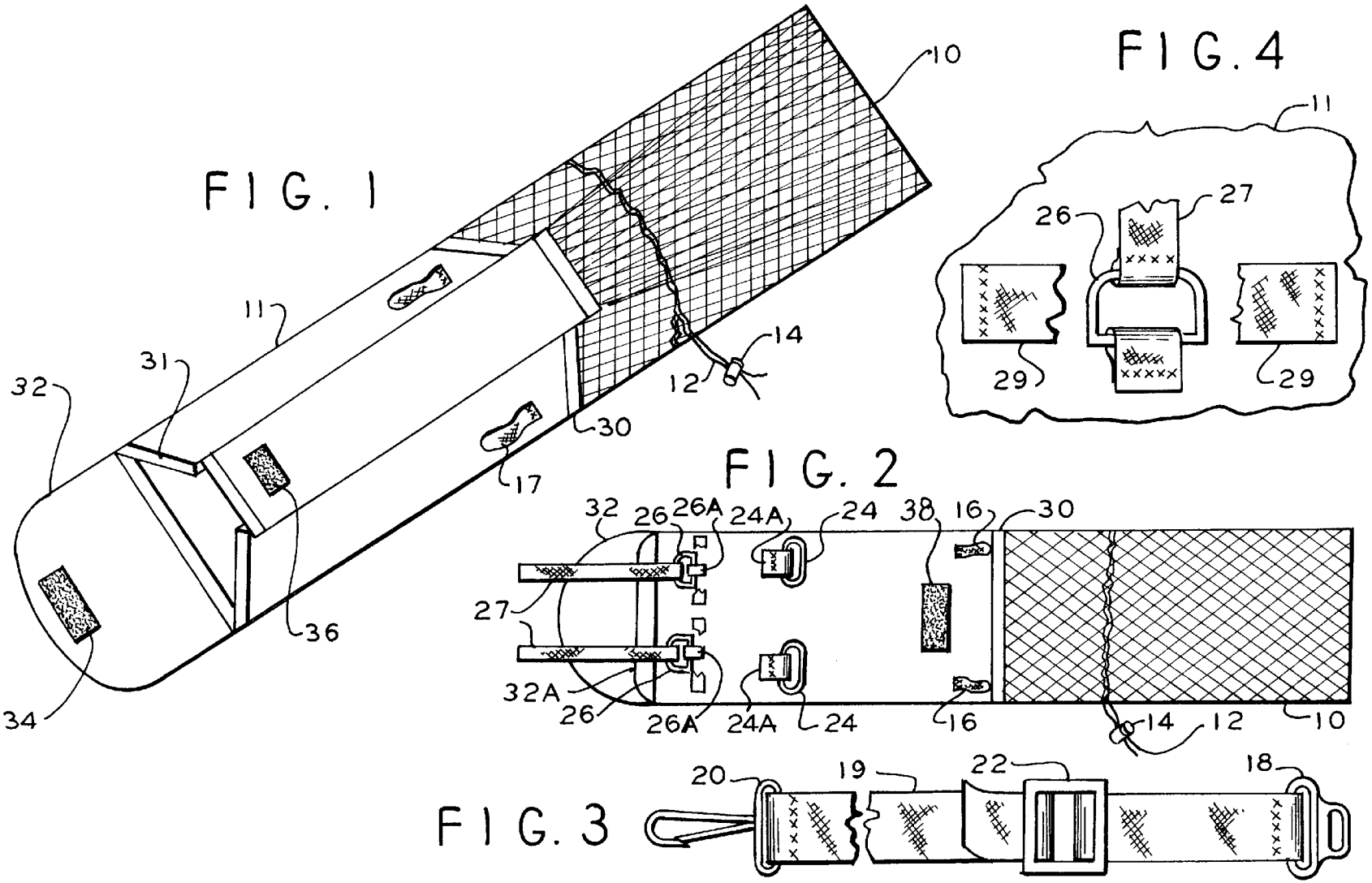
FIG. 1 is an axonometric view of a bag in accordance with the principles of the present invention in a fully extended configuration.
FIG. 2 is a rear view of the bag of FIG. 1.
FIG. 3 is a detailed view of a connecting strap that can be used with the bag of FIG. 1.
FIG. 4 is a detailed view of one of the rings on the back of the bag of FIG. 2.

Referring to the bag shown in FIGS. 1 and 2, the preferred embodiment is displayed in full size configuration. The bag is composed of two sections. The bottom pouch 10 is made of a mesh material. The top of the mesh pouch has a rectangular opening which is tapered down to the bottom to form a straight edge. A cord 12 approximately 24 inches (61 cm) long and preferably made of nylon is woven through the mesh to form a drawstring positioned about one third of the distance from the top of the mesh. The nylon cord 12 is secured with a cord lock 14 and acts as a restrict means to deny access to pouch 10.

The upper portion 11 of the bag is a tubular sleeve and is preferably made of nylon. Stitched into the upper and lower hems of sleeve 11 are six inner battens 30 and six outer battens 31 (shown in phantom) to hold the shape of the bag in its various configurations. The battens 30 and 31 provide stiffness and form to the nylon bag and allow the bag to be flattened in an orderly manner. Outer battens 31 shape the closable mouth of sleeve 11. The hems of the nylon sleeve 11 are folded over the batten and sewn closed to hold the battens in place. The battens are of different sizes, with the largest batten in the back of the bag and the smallest in the front. The remaining four battens are arranged accordion-style to allow the bag to be folded into a predetermined shape. The annular seam connecting the lower pouch 10 and upper sleeve 11 is sewn at the battens 30. Thus battens 30 also hold the nylon mesh 10 in place.

Referring to FIG. 2 and 4, the back of the upper sleeve 11 has an upper pair of outer spaced rings 26 and a lower pair of spaced inner rings 24 attached by separate cloth loops 26A and 24A, respectively. The rings 24, 26 are used for attachment of removable carrying straps, as will be described presently. Upper rings 26 are covered in FIG. 4 by a pair of reinforcing strips 29 that are stitched to sleeve 11 on opposite sides of the rings 26, although rings 26 can be pulled out from under strips 29 as shown in FIG. 2.

Permanently attached to the upper rings 26 are two separate bands 27 that are hooked around the rings and sewn together into a small loop. The rest of the band 27 has mating strips made of Velcro™ hook and loop fastening material to enable the straps to be connected to itself to form a larger loop or to the other strap to form a handle.

In addition, two pairs of straps 17 and 16 are sewn on the front and back, respectively of the upper sleeve 11 at its lower edge. The straps of each pair are spaced apart and have strips made of Velcro™ hook and loop fastening material to allow each pair to be closed into releasable loops. As described further hereinafter, these loops can be used as a restrict means to secure the lower mesh section in a rolled up condition.

The top flap 32 is also made of nylon and is composed of two overlaid pieces sewn together. The pieces are sewn together with reinforced nylon edging (not shown) everywhere but at the joint with sleeve 11 to form a pocket with rounded corners. A strip made with Velcro™ hook and loop fastening material used to fasten the flap 32 to the body of the sleeve 11 is located on the top inside edge. The space between the two pieces of nylon form a pocket to hold small objects such as coins and may be closed by a second flap 32A.

Referring to FIG. 3, shoulder strap 19 is used in some configurations of the bag to provide additional versatility. Strap 19 is preferably made of nylon and is approximately 1½ inches (3.8 cm) wide and 30 inches (76 cm) long. Strap 19 has a ring 18 sewn to one end and a clip 20 sewn to the other end. Near the D-ring end, strap 19 has adjuster clip 22 that allows the strap to be shortened or lengthened by adjusting the amount of strap that is folded through the adjuster clip.

To facilitate an understanding of the principles associated with the foregoing apparatus, its operation will be briefly described. The bag of FIGS. 1, 2 and 4 can be used in several different size configurations: full size, mid-size and compact size. In the full size configuration as shown in FIG. 2, the mesh 10 is useful for shedding water, sand, or other debris that may be on articles carried inside the bag.

The two ends of shoulder strap 19 (FIG. 3) may be connected between the two rings 26. Clip 20 can be attached directly to one of the rings 26. The band 27 on the other ring 26 can be looped and closed around the eye of ring 18 of strap 19. In some embodiments the length may be doubled by connecting two identical straps together, end to end. Both strap clips 20 are then fastened to each other and the rings 18 on the opposite ends of the straps are connected to the rings 26 using the bands 27.

Shoulder strap 19 may be shortened by sliding it through the strap adjuster 22 so that more of the strap is folded back on itself through the adjuster. To lengthen the strap pull the strap in the opposite direction. In this arrangement, the bag can be hung by strap 19 from a tree and used as a camping food bag.

In some instances, the two bands 27 can be connected together to form a carrying handle. Alternatively, one of the bands 27 can be looped through one of the rings 26 and closed on itself to form a smaller handle. The user may use the handle for manually carrying the full size bag or for tieing the bag to a support. For example, the bag may be tied to a boat or an anchor line to store live bait, chum or the catch of the day. In some instances the full size bag may be carried as a backpack, using a pair of straps in a manner described hereinafter.

Figure 5:
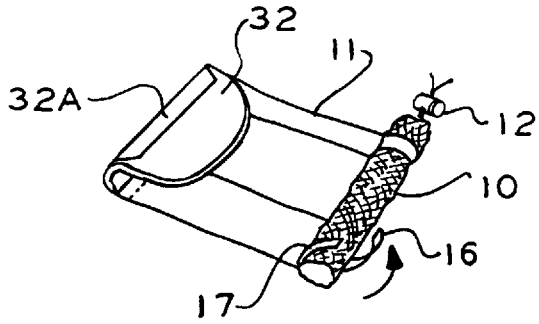
FIG. 5 is an axonometric view of the bag of FIG. 1 with the bottom mesh pouch rolled up and secured with straps.

In the mid-size configuration shown in FIG. 5, the mesh pouch 10 is tightly rolled from the bottom toward the upper section. Then pouch 10 is secured in place by closing the two pairs of straps 16,17 around the rolled pouch 10. Straps 16,17 are held together by strips made of Velcro™ hook and loop fastening material to act as a sling. This forms a mid-size bag with a tapered bottom.

Figure 9:
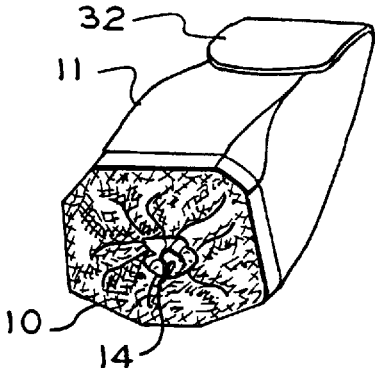
FIG. 9 is a bottom, axonometric view of bag of FIG. 1 with the mesh pouch tucked inside and the drawstring closed.
Figure 10:
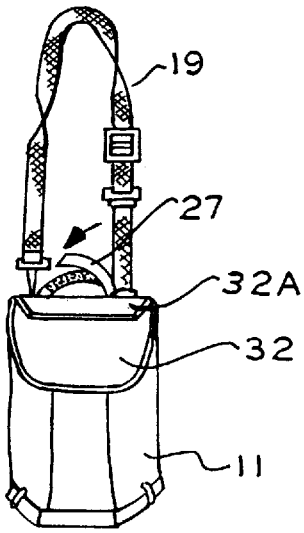
FIG. 10 is an axonometric view of the bag of FIG. 9 fitted with a shoulder strap.

An alternate mid-size bag is formed by cinching drawstring 12 as shown in FIG. 9. The cinched bottom is kept closed with cord lock 14 and forms a square bottom when the bag is converted into a mid size configuration. To form this mid-size configuration, first tuck the portion of mesh pouch 10 that is below the drawstring 12 into the bottom of the upper sleeve 11 as shown in FIG. 9, then slide the cord lock 14 toward the bag to secure it in place. The loose ends of cord 12 is then tucked into the mesh.

Regardless of configuration the bag is closed by folding flap 32 down to attach together the strip 34 on flap 32 and strip 36 on the sleeve 11 i n the front of the bag (strips 34 and 36 being made with Velcro™ hook and loop fastening material).

Figure 6:
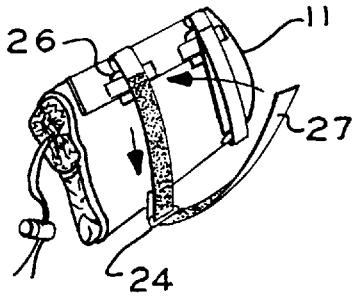
FIG. 6 is an axonometric, rear view of the bag of FIG. 5 folded into its smallest configuration.
Figure 7:
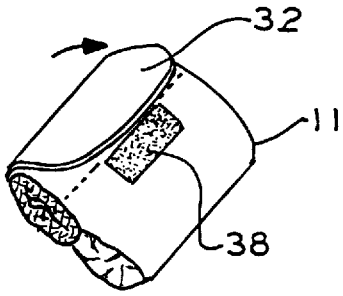
FIG. 7 is a front, axonometric view of the bag of FIG. 6.
Figure 8:
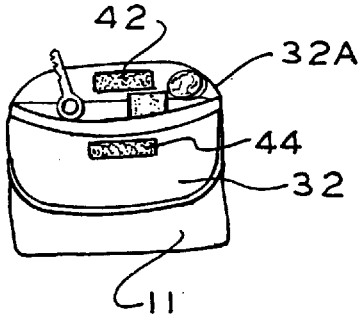
FIG. 8 is a view of the coin pocket portion of the bag of FIG. 6.

FIGS. 6, 7 and 8 show the compact version of the bag. The bottom half of the sleeve 11 bag is folded up. Then strip 34 (FIG. 1) on the flap 32 is connected to the strip 38 (FIGS. 2 and 7) on the back of the sleeve 11, thereby acting as a closing means (strips 34 and 38 being made with Velcro™ hook and loop fastening material).

When closed as shown in FIG. 8, a user can still gain access to the pocket in flap 32. This pocket may be used to hold coins or other small objects. Cover 32A of this pocket can be held closed by strip 42 on the top cover and strip 44 on the outside of flap 32.

Figure 12:
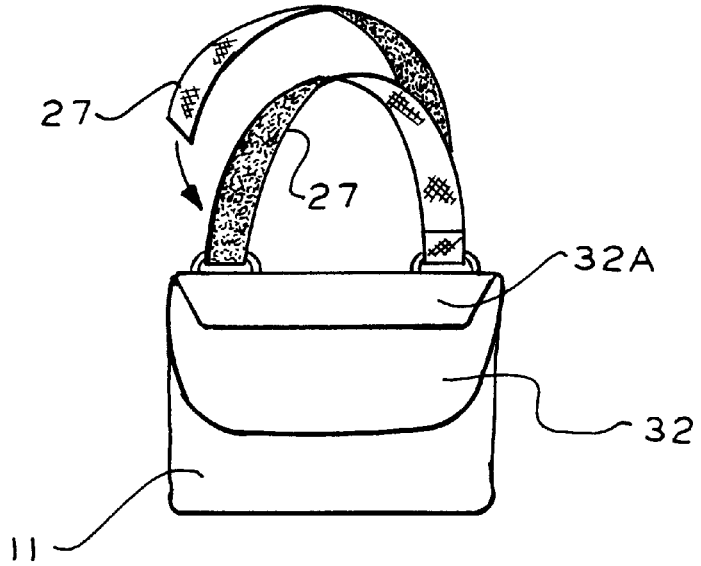
FIG. 12 is a front view of the bag of FIG. 6 with straps configured into a large handle.

In this configuration, the bag can be attached to a support element by using the bands 27 as shown in FIG. 6. Here the two bands 27 may be looped through rings 24 and secured to themselves to form a pair of hangers. This allows the bag to be connected to various slender articles, such as a waist belt or a bicycle handlebar (neither shown). Alternatively, the straps 27 can be undone from rings 24 and connected together to form the large handle shown in FIG. 12.

Figure 11:
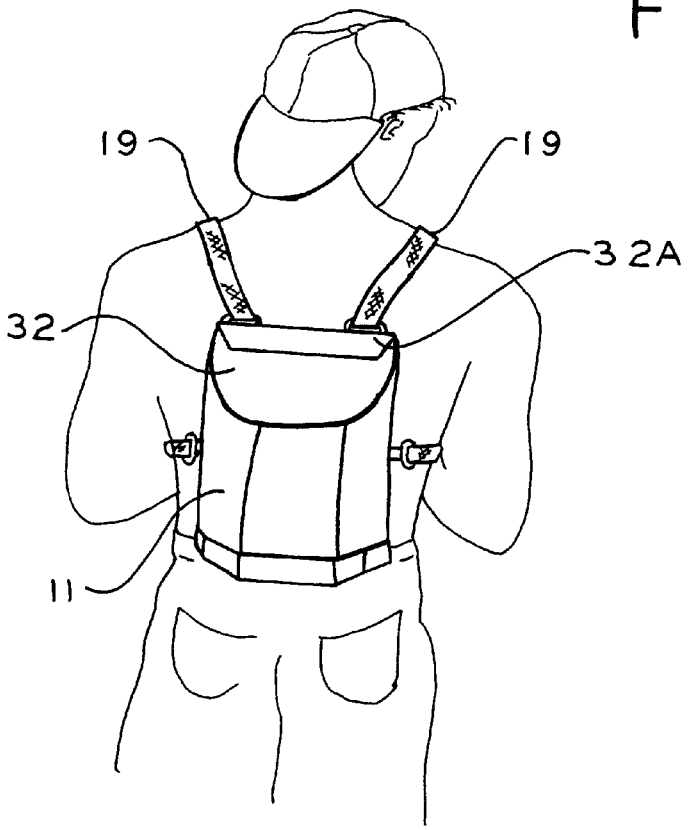
FIG. 11 is an axonometric view of the bag of FIG. 9 fitted with a pair of straps and being worn as a backpack.

The bag has many different uses and configurations and can be modified for specific situations. In the smallest configuration it can be attached to a belt for diving, a bicycle handlebar or a waist as coin belt. In the mid-size version, there is a larger compartment and the configuration allows the unit to be carried by hand, on the shoulder or as a backpack as shown in FIG. 11. The backpack is achieved with a pair of the straps 1 9 (acting as shoulder harnesses) secured to the rings 24, 26 on the back of the bag.

It is to be appreciated that various modifications may be implemented with respect to the above described preferred embodiments. For example, the fabric of various sleeves, flaps, etc. can be knitted or weaved from various natural or synthetic fibers, sheet plastic, leather, and other materials. Instead of fasteners made with Velcro™ hook and loop fastening material, other embodiments may use snaps, zippers, buckles, etc. The bag may have more or less than the illustrated number of rings and straps. The mesh may be formed of a network of interlinked cords or from a foraminous sheet of plastic, cloth or other material. The various components can be attached by stitching, riveting, glueing or other means.

Obviously, many modifications and variations of the present invention are possible in light of the above teachings. It is therefore to be understood that within the scope of the appended claims, the invention may be practiced otherwise than as specifically described.

What is claimed is:

1. A multi-purpose bag comprising:

a pouch;

a sleeve attached to said pouch along a seam, said sleeve having a closable mouth; and restrict means for stowing said pouch to stop communication from inside said sleeve to inside said pouch, said restrict means including a drawstring threaded through said pouch at a predetermined distance from said seam for forming with said pouch a bottom for said sleeve by cinching said pouch, said seam including a separate stiffening member allowing said pouch to form a flat bottom for the sleeve when said drawstring is cinched.

2. A multi-purpose bag according to claim 1 wherein said pouch comprises a mesh.

3. A multi-purpose bag according to claim 1 wherein said restrict means is operable to choke said pouch closed near said sleeve.

4. A multi-purpose bag according to claim 3 comprising:

closing means for keeping said sleeve folded transversely.

5. A multi-purpose bag according to claim 1 wherein said stiffening member comprises a batten.

6. A multi-purpose bag according to claim 1 wherein said restrict means is operable to choke said pouch closed after said pouch is pushed into said sleeve inside out.

7. A multi-purpose bag according to claim 2 wherein said restrict means is operable to bundle said pouch adjacent to and outside of said sleeve.

8. A multi-purpose bag according to claim 7 wherein said restrict means comprises:

a sling for releasably spanning opposite sides of said sleeve and for holding said pouch adjacent to said sleeve.

9. A multi-purpose bag according to claim 1 comprising:

closing means for keeping said sleeve folded transversely.

10. A multi-purpose bag according to claim 9 wherein said restrict means is operable to bundle said pouch adjacent to and outside of said sleeve.

11. A multi-purpose bag according to claim 9 wherein said closing means comprises:

a flap mounted at said closable mouth of said sleeve.

12. A multi-purpose bag according to claim 11 wherein said sleeve includes:

a pocket at said closable mouth.

13. A multi-purpose bag according to claim 1 comprising:

a plurality of outer battens peripherally mounted along said closable mouth of said sleeve.

14. A multi-purpose bag according to claim 13 comprising:

a plurality of inner battens peripherally mounted along said sleeve opposite said closable mouth.

15. A multi-purpose bag according to claim 1 comprising:

a pair of bands each having a fixed end separately fixed to said sleeve, said bands having free ends releasably interconnectable to form a handle.

16. A multi-purpose bag according to claim 15, wherein the free ends of said bands are adapted to be secured lengthwise along said sleeve to form a spaced pair of parallel hangers.

17. A multi-purpose bag according to claim 15 comprising:

a spaced pair of inner rings attached to said sleeve, said free ends of said bands being adapted to be secured through separate ones of said inner rings to form a spaced pair of parallel hangers.

18. A multi-purpose bag according to claim 17 comprising:

a spaced pair of outer rings attached to said sleeve, said fixed ends of said bands being separately attached to said outer rings.

19. A multi-purpose bag according to claim 17 comprising:

at least one reinforcing strip overlaying at least one of said outer rings.

20. A multi-purpose bag according to claim 18 comprising:

a pair of shoulder harnesses, e ach connected between a separate corresponding one of said inner rings and a separate corresponding one of said outer rings.

21. A multi-purpose bag according to claim 18 comprising:

a shoulder strap connected between said outer rings.

22. A multi-purpose bag comprising:

a pouch;

a sleeve adjoined to said pouch, said sleeve having a closable mouth;

restrict means for stowing said pouch to stop communication from inside said sleeve to inside said pouch; and a pair of bands each having a fixed end separately fixed to said sleeve, said bands having free ends adapted to be alternately (a) releasably interconnected to form a handle, or (b) releasably secured lengthwise along said sleeve to form a spaced pair of parallel hangers;

a spaced pair of inner rings attached to said sleeve, said free ends of said bands being adapted to be selectively secured through separate ones of said inner rings to form said spaced pair of parallel hangers; and a pair of shoulder harnesses, each connected between a separate corresponding one of said inner rings and a separate corresponding one of said bands, said bands being unconnected to each other and to said inner rings.

23. A multi-purpose bag according to claim 22 comprising:

a spaced pair of outer rings attached to said sleeve, said fixed ends of said bands being separately attached to said outer rings.

24. A multi-purpose bag according to claim 23 comprising:

at least one reinforcing strip overlaying at least one of said outer rings.

* * * * *